US005147243A

United States Patent [19]

Inglis et al.

[11] Patent Number: 5,147,243

[45] Date of Patent: Sep. 15, 1992

[54] AIR TERMINAL APPARATUS

[75] Inventors: Stephen C. Inglis, Kirkville, N.Y.; Carl C. Herb, Savannah, Ga.

[73] Assignee: Carrier Corporation, Syracuse, N.Y.

[21] Appl. No.: 698,205

[22] Filed: May 10, 1991

[51] Int. Cl.[5] ..... F24F 13/10

[52] U.S. Cl. ..... 454/323; 454/906

[58] Field of Search ..... 98/40.16, 41.1, 41.2, 98/DIG. 10

[56] References Cited

U.S. PATENT DOCUMENTS

| | | | |
|---|---|---|---|
| 3,058,491 | 10/1962 | Myhre | 98/41.1 X |
| 4,399,739 | 8/1983 | Dean | 98/41.1 |
| 4,442,760 | 4/1984 | Dean et al. | 98/40.16 X |
| 4,811,575 | 3/1989 | Currier et al. | 98/41.1 |

*Primary Examiner*—Harold Joyce

[57] ABSTRACT

In an air terminal having an inflatable bellows expanding toward a pair of spaced cut-off plates, a sealing element is attached to the central portion of that side of the bellows adjacent to the cut-off plates. The transversely extending ends of the sealing element are not secured to the bellows but are free to separate therefrom as the bellows is expanded to thereby more easily engage the cut-off plates. A pair of foam strips are provided near the transverse ends of the sealing element so as to thereby provide a substantially normally extending surface against which the flowing air will impinge so as to thereby reduce the sound emanating therefrom. A pair of vibration damper clips extend from the cut-off plates and engage the foam strips to prevent any vibration thereof. Pads are secured to the edges of the cut-off plates so as to engage the seal element then thereby enhancing the sealing relationship between the cut-off plates and the seal element.

9 Claims, 3 Drawing Sheets

AIR TERMINAL APPARATUS

BACKGROUND OF THE INVENTION

The flow of cooled air from a duct to a space to be cooled is commonly controlled by way of a variable volume, air distribution terminal. In such a unit, an inflatable bellows or bladder damper typically cooperates with a cut-off plate to define an air flow passage whose width varies inversely with the degree of inflation of the bellows. The degree of bellows inflation is, in turn, controlled in response to the load in the space to be conditioned.

In order to maintain the desired volumetric flow from the terminal, it is important that the air flow passage width be uniform along the entire length of the terminal. It is also important that the air flow passage defining structure be uniform along its entire length such that when the terminal is open, the flow passage width is uniform along its length, and when the terminal is closed, the flow passage is closed along its entire length such that no leakage occurs. Further, it is important that the sound resulting from the flow of air from such a terminal be minimized.

Consideration was given to the above described requirements in the apparatus shown and described in U.S. Pat. No. 4,811,575 assigned to the assignee of the present invention. Here, a foam material was used between the bellows and the cut-off plates to assist in maintaining a proper sealing relationship between the two elements for complete cutoff of air flow when the unit is closed. A foam material was also used, both on the bellows structure and on the cutoff plates, to provide the function of reducing noise caused by the flow of air from the unit. The structure, however, is relatively complex, thereby rendering it relatively expensive, both in terms of material and in time to properly assemble the unit.

It is therefore an object of the present invention to provide a simplified structure for an air terminal.

Another object of the present invention is the provision for an air terminal which controls the flow of air in a uniform and precise manner.

Yet another object of the present invention is the provision for an air terminal apparatus which allows for minimal leakage when in the off condition.

Yet another object of the present invention is the provision in an air terminal for minimizing the noise resulting from the flow of air.

Still another object of the present invention is the provision for an air distribution terminal which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, a closed cell, seal element is attached to the central portion of the bellows, opposite the air flow slot, but with the transversely extending ends being free from attachment to the bellows such that they can engage the respective cut-off plates on their one sides without engaging the bellows structure on the other sides thereof. In this way, complete shut off may be effected with a relatively simple structure.

In accordance with another aspect of the invention, a strip of open-cell foam material is attached to each of the transversely extending free ends of the seal element, on the side opposite that of the bellows structure. The foam strips are located transversely outside the cut-off plates and are of sufficient thickness such that a side wall thereof extends substantially normally from the seal element surface so that a substantial part of the discharge flow in the air flow passage is directed toward said side wall.

By yet another aspect of the invention, a plurality of spring-like vibration damper clips are attached to the cut-off plate supporting structure and extend therefrom in such a manner as to continually maintain engagement with the open-cell foam strips so as to thereby dampen any vibrations that might otherwise occur.

In the drawings as hereinafter described, a preferred embodiment is depicted; however, various other modifications and alternate constructions can be thereto without departing from the true spirit and scope of the invention.

DESCRIPTION OF THE PREFERRED EMBODIMENT

Figure 1:
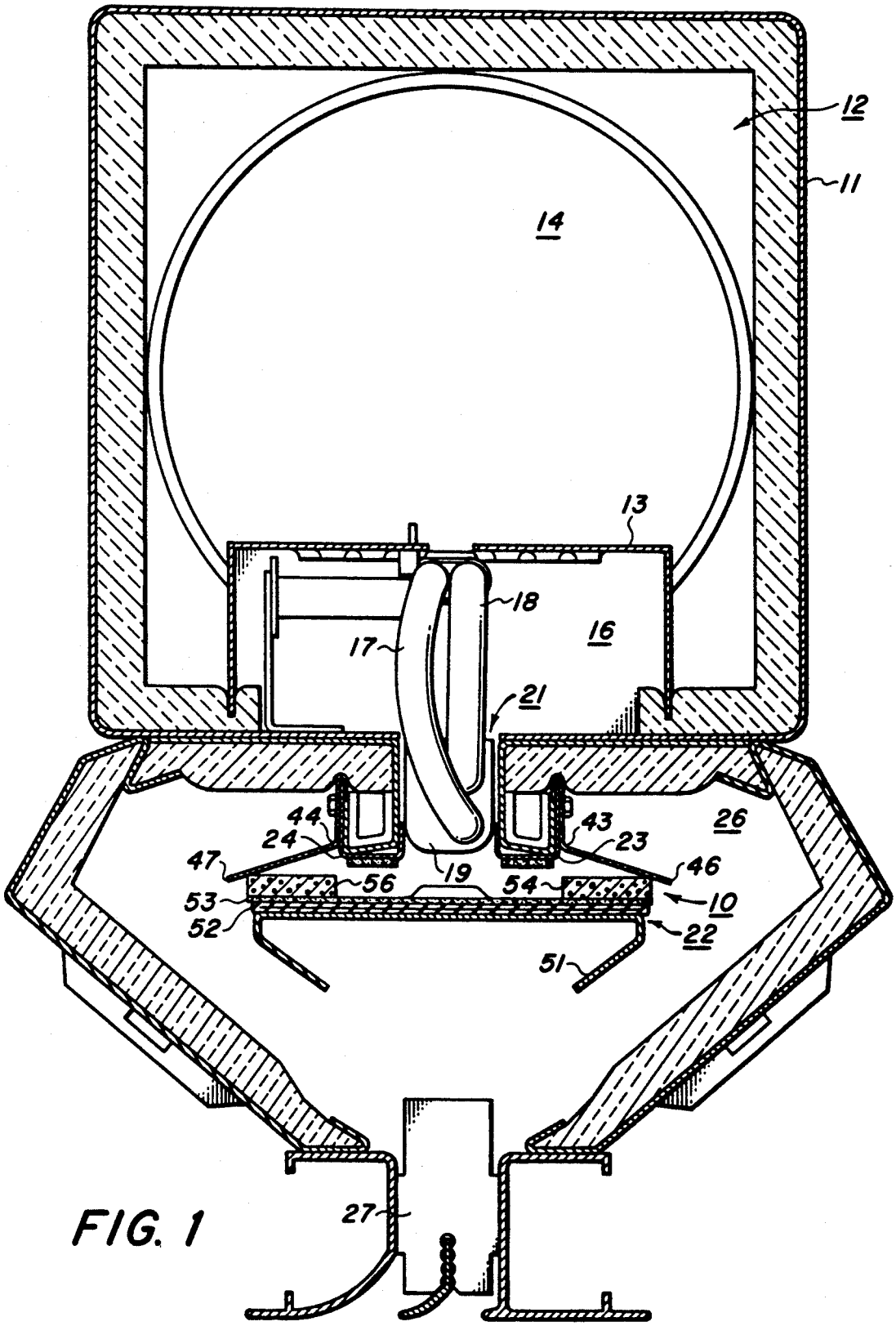
FIG. 1 is a sectional view of an air terminal having the present invention incorporated therein.

Referring now to FIG. 1, the invention is shown generally at 10 as incorporated into an air terminal device 11. Within a plenum 12, a nozzle plate structure 13 is provided to define the interface between a high pressure area 14 and a low pressure area 16. A high pressure pickup tube 18 extends through the nozzle plate 13 and into the high pressure area 14 to provide a high pressure input to a flow control device 19. A low pressure pick up tube 17 is located within the low pressure area 16 and provides a low pressure signal to the flow control device 19.

In the open position illustrated in FIG. 1, air flows from the high pressure area 14, through the nozzle plate 13, and into the low pressure area 16. It then passes through slot 21 and impinges upon the bellows assembly 22, where it is diverted substantially 90° into two flow passages 20 and 25, thereby passing between the bellows assembly 22 and the cut-off plates 23 and 24. The flow then passes into a mixing chamber 26 and hence to a diffuser 27 from which it is discharged into the space to be conditioned.

Figure 2:
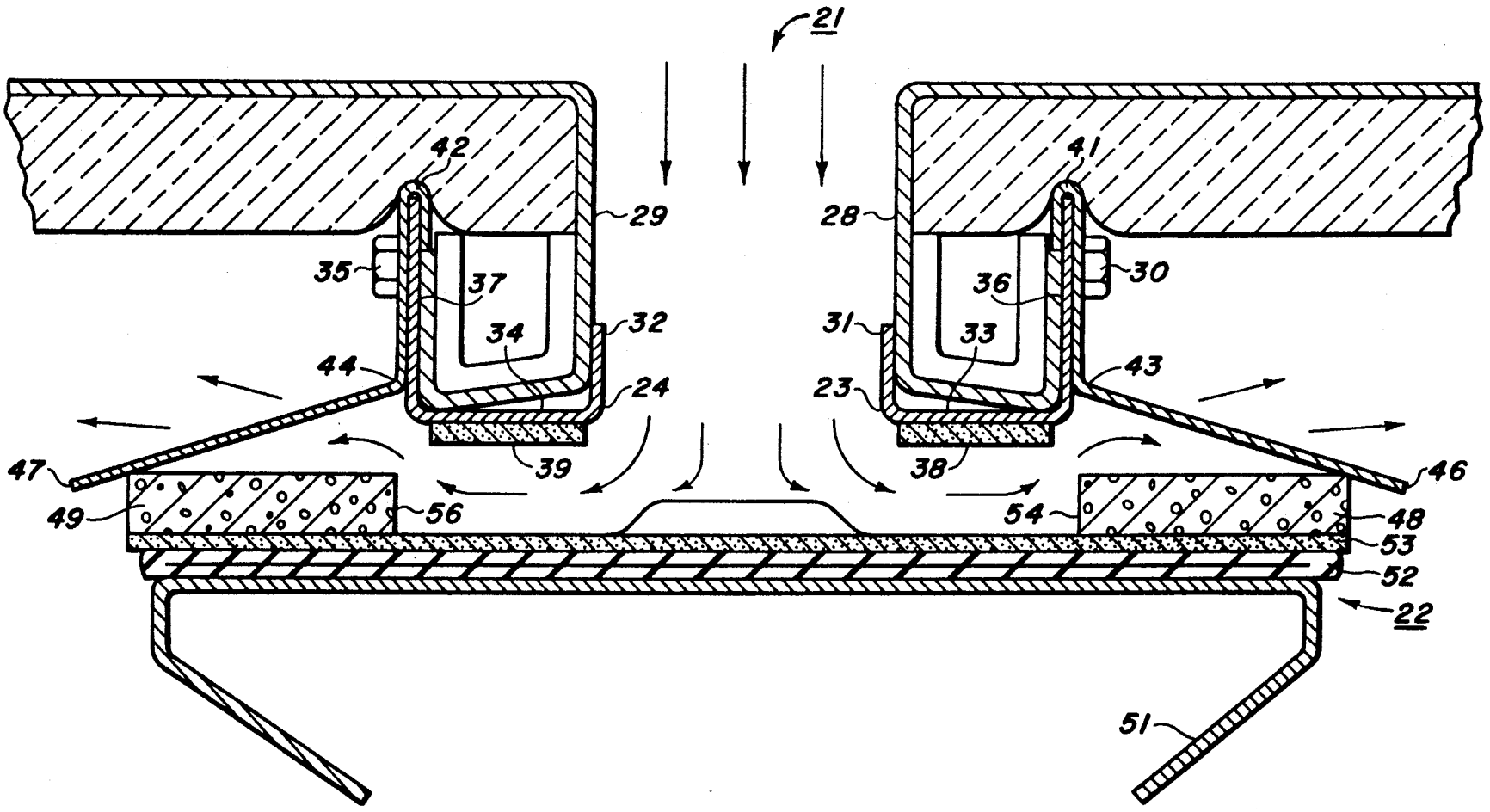
FIG. 2 is an enlarged sectional view of a portion thereof.

Referring now to FIG. 2, the structures of the cut-off plates 23, 24, and the bellows assembly 22, with the conditioned air passing thereover, and eventually through passages 20 and 25, are shown in a greater particularity. In addition to the cut-off plates 23 and 24, the elongate slot 21 is defined by a pair of channel members 28 and 29 running the length (i.e. into the paper) of the slot 21. The cut-off plates 23 and 24 are U shaped members having first sides 31 and 32, second sides 33 and 34, and third sides 36 and 37, respectively. The third sides 36 and 37 are secured, by fasteners 30 and 35, to the respective channel members 28 and 29.

Attached to the outer surfaces of second sides 33 and 34 by an adhesive or the like are pad strips 38 and 39 that run the length of the slot 21. The pads 38 and 39 are formed of a flexible, closed cell, crosslinked polyethylene, foam material, which is commercially available from Voltek Inc. under the designation Minicel L-200. The function of these pads is to enhance the closure process by providing a good sealing relationship between the bellows assembly 22 and the cut-off plates 23 and 24 when the bellows assembly 22 is moved to the closed position. Also these pads reduce the noise generated by the flow of air in a partially throttled position.

Attached to the cut-off plate third sides 36 and 37 by clip ends 41 and 42 are vibration damper clips 43 and 44 which have free ends 46 and 47 extending obliquely downwardly to engage respective pads 48 and 49 as shown in FIG. 2. Pads 48 and 49, whose function will be described hereinafter, extend the full length of the slot 21. The vibration damper clips 43 and 44, on the other hand, are narrow clips that are located at three distributed locations along the length of the slot 21 such that they offer no significant impedance to the air flow from the unit. The purpose of the vibration damper clips 43 and 44 is to prevent vibrations of the bellows assembly 22 as may otherwise be caused by the flow of air thereover. In this regard, it should be recognized that the vibration damper clips 43 and 44 continually remain in contact with the pads 48 and 49 near the free ends 46 and 47, as shown, including both time periods in which the bellows assembly 22 is completely deflated and those in which it is in the fully open position as shown on FIG. 2. As the bellows assembly 22 is inflated to close off the air flow through passages 20 and 25, the vibration damper clips 43 and 44 are caused to flex upwardly so as to accommodate such inflation. The bellows assembly 22 comprises a retainer element 51, a bellows bag assembly 52, and a sealing element 53. The bellows bag assembly 52 is formed and operates in a conventional manner to be selectively inflated by way of an appropriate air source which causes air to selectively go into and out of the bellows in a controlled manner so as to thereby selectively vary the width of the passages 20 and 25 between the pads 38 and 39 and the sealing element 53 so as to control the flow of air from the unit. Both the bellows bag 52 and the sealing element 53, extend the length of the slot 21.

The bellows bag 52 is formed of a suitable elastomeric material which is capable of repeated inflation and deflation cycles with long life capabilities. The sealing element 53 is 1/16 inch thick and is composed of the same crosslinked polyethylene, foam material (i.e. Minicel L - 200) as the pads 48 and 49. The pads 48 and 49, however, are formed of an open cell foam material which is commercially available from Packaging Service Corp under the designation #L145CZ. The sealing element 53 is secured, by a suitable adhesive 50 such as Packaging Service Corp under the designation PSC #270, to the bellows bag 52. However, rather than being entirely glued to the bellows bag 52, it is only secured along a central portion (i.e. directly across from the slot 21), such that the transversely extending ends are free to separate from engagement with the bellows bag on their one side and instead engage the pads 38 and 39 on the other side when the bellows 52 is inflated. This can be seen by reference to FIG. 5 wherein the terminal is in the closed position, with the bellows bag 52 in the fully inflated condition.

Figure 3:
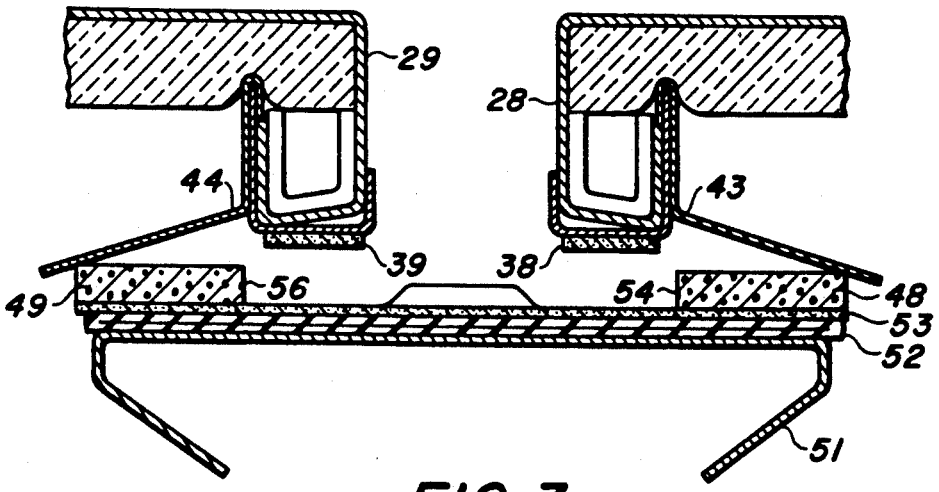
FIGS. 3–5 are schematic illustrations thereof with the bellows in various degrees of inflation.
Figure 4:
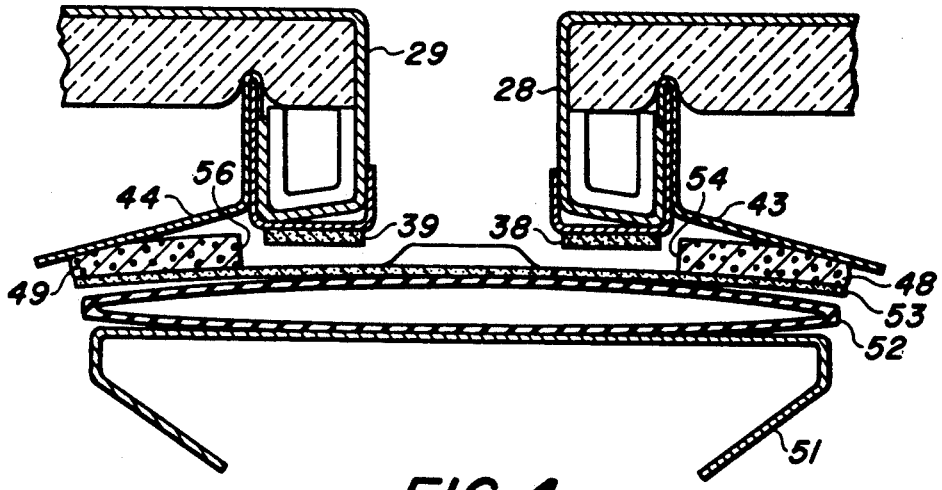
Figure 5:
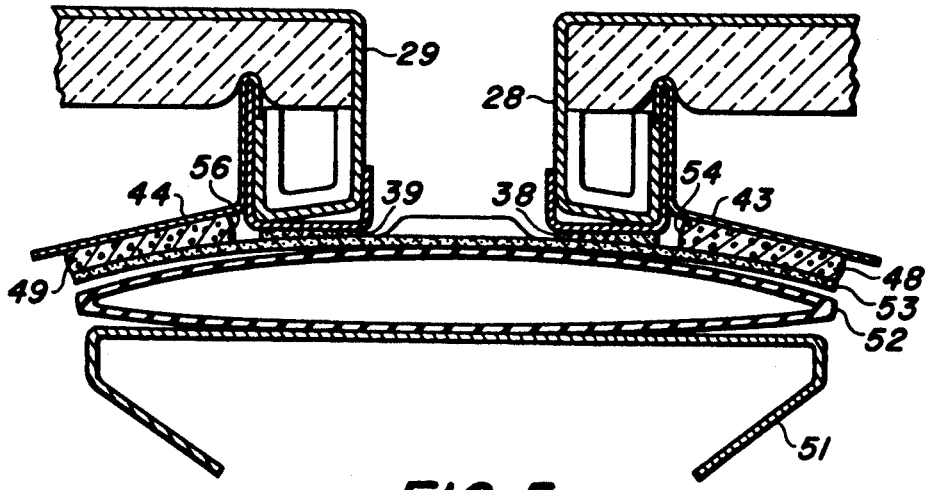

Referring now to FIGS. 3-5, the assembly is shown in three different stages of inflation. In FIG. 3, the bellows bag 52 is fully deflated, such that the maximum clearance is provided in the passages 20 an 25 between the sealing element 53 and the pads 38 and 39. Here, the terminal is fully open such that the maximum amount of air is allowed to flow from the slot 21, through the passages 20 and 25, and into the mixing chamber 26 and through the diffuser 27. In this condition, the air flow pattern is shown in FIG. 2 wherein a substantial portion of the air flowing from the unit impinges directly on one of the sides 54 or 56 of the respective pads 48 and 49, the sides 54 and 56 extending substantially normally from the surface of the sealing element 53. Since the pads 48 and 49 are composed of an open cell, foam material, any sounds that are generated by the flow of air tend to pass into the pads 48 and 49 so as to thereby be absorbed and muffled.

Referring again to FIG. 3-5, the vibration damper clips 43 and 44 are always in engagement with the pads 48 and 49 to thereby reduce or eliminate any vibration damper that would otherwise occur. As will be seen, as the bellows bag is inflated to the intermediate position as shown in FIG. 4 and finally to the fully inflated (i.e. closed) position as shown in FIG. 5. As will be seen, the vibration damper clips 43 and 44 tend to deflect upwardly as the bellows bag 52 is inflated, so as to, at all times, remain in direct engagement with the pads 48 and 49.

The advantage of having the sealing element 53 secured to the bellows bag 52 by the adhesive 50 applied only in the central portion thereof will be recognized by reference to FIGS. 4 and 5 wherein, during the inflation of the bellows bag 52, the free ends of the sealing element are free to separate from the surface of the bellows bag 52 and extend upwardly such that they can more easily engage the pads 38 and 39 to thereby effect closure.

While the present invention has been disclosed with particular reference to a preferred embodiment, the concepts of this invention are readily adaptable to other embodiments, and those skilled in the art may vary the structure and/or method thereof without departing from the essential spirit of the invention.

What is to be claimed is:

1. An improved air terminal of a type having an elongate slot at least partially defined by a pair of spaced cut-off plates, a plenum fluidly connected to the slot for supplying a flow of air thereto, and an inflatable bellows located adjacent the cut-off plates so as to be selectively expandable toward the plates to thereby impede the discharge flow of air from the slot, wherein the improvement comprises:

a seal element disposed between the bellows and the cut-off plates and secured at a central portion thereof to a central portion of the bellows, with said transversely extending ends of said seal element not being attached to said bellows but extending to a transverse extent so as to overlap the cut-off plates, said seal element being composed of a closed cell material which is moved by the expanding bellows toward the cut-off plates to reduce the flow of air therefrom; and a pad attached to each of the respective cut-off plates, between the respective cut-off plates and said seal element, so as to be engageable of said bellows to thereby enhance the sealing relationship between said seal element and said cut-off plates, said pads being composed of a closed cell material.

2. An improved air terminal as set forth in claim 1 and including a pair of foam strips located on and supported by said seal element, said strips being located transversely outside the respective cut-off plates and being in the flow path of the air flow discharge so as to reduce the noise caused thereby.

3. An improved air terminal as set forth in claim 2 wherein said strips each have a side wall extending substantially normally from the seal element such that a substantial portion of the discharge flow from the slot is caused to impinge against said side wall.

4. An improved air terminal as set forth in claim 2 wherein said pads and said foam strips extend substantially the entire length of said slot.

5. An improved air terminal as set forth in claim 1 wherein said seal element is comprised of a closed cell, foam material.

6. An improved air terminal as set forth in claim 2 wherein said foam strips are comprised of an open cell, foam material.

7. An improved air terminal as set forth in claim 1 wherein said seal element is attached to said bellows by way of an adhesive material.

8. An improved air terminal as set forth in claim 2 wherein said foam strips are secured to said seal element by way of an adhesive material.

9. An improved air terminal of a type having an elongate slot at least partially defined by a pair of spaced cut-off plates, a plenum fluidly connected to the slot for supplying a flow of air thereto, and an inflatable bellows located adjacent the cut-off plates so as to be selectively expandable toward the plates to thereby impede the discharge flow of air from the slot, wherein the improvement comprises:

a seal element disposed between the bellows and the cut-off plates and secured at a central portion thereof to a central portion of the bellows, with said transversely extending ends of said seal element not being attached to said bellows but extending to a transverse extent so as to overlap the cut-off plates, said seal element being composed of a closed cell material which is moved by the expanding bellows toward the cut-off plates to reduce the flow of air therefrom;

a pair of foam strips located on and supported by said seal element, said strips being located transversely outside the respective cut-off plates and being in the flow path of the air flow discharge so as to reduce the noise caused thereby;

and at least one vibration damper clip attached to a structure associated with one of said cut-off plates and extending toward one of said foam strips to thereby engage said foam strip and prevent vibrations thereof.

* * * * *